US005960867A

United States Patent [19]

Takahashi et al.

[11] Patent Number: 5,960,867

[45] **Date of Patent: *Oct. 5, 1999**

[54] CONDENSER AND POWER PLANT

[75] Inventors: Fumio Takahashi, Hitachi; Iwao Harada, Mito; Yasuo Fujitani, Tokai-mura, all of Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/565,894

[22] Filed: Dec. 1, 1995

[30] Foreign Application Priority Data

Dec. 2, 1994 [JP] Japan ..... 6-299271

[51] Int. Cl.[6] ..... F28B 9/10

[52] U.S. Cl. ..... 165/114; 165/DIG. 203

[58] Field of Search ..... 165/114, 112, 165/113, 910, DIG. 202, DIG. 203

[56] References Cited

U.S. PATENT DOCUMENTS

| | | | |
|---|---|---|---|
| 1,406,356 | 2/1922 | Ehrhart | 165/114 |
| 1,626,849 | 5/1927 | Lucke | 165/114 |
| 1,662,154 | 3/1928 | Lucke | 165/114 |
| 1,662,186 | 3/1928 | Grace | 165/114 |
| 1,704,471 | 3/1929 | Grace | 165/97 |
| 1,704,484 | 3/1929 | Lucke | 165/114 |
| 1,718,466 | 6/1929 | Kirgan | 165/114 |
| 1,745,857 | 2/1930 | Lucke | 165/114 |
| 1,827,827 | 10/1931 | Smith | 165/112 X |
| 2,114,873 | 4/1938 | Coulson, Jr. | 165/113 |
| 4,958,679 | 9/1990 | Drosdziok et al. | 165/112 X |
| 4,967,833 | 11/1990 | Blangetti et al. | 165/114 |

FOREIGN PATENT DOCUMENTS

| | | | |
|---|---|---|---|
| 7539721 | 11/1976 | Germany . | |
| 836 | 1/1980 | Japan | 165/114 |
| 114087 | 5/1986 | Japan . | |
| 242088 | 9/1990 | Japan . | |
| 244589 | 9/1992 | Japan . | |
| 261437 | 11/1926 | United Kingdom | 165/114 |
| 822759 | 10/1959 | United Kingdom | 165/910 |

*Primary Examiner*—Leonard Leo
*Attorney, Agent, or Firm*—Antonelli, Terry, Stout & Kraus, LLP

[57] ABSTRACT

A tube nest of a compact condenser has flow passages, tube bundles and a noncondensable gas extracting opening. The tube nest is installed in a vessel having a bottom surface. The tube nest is spaced from the bottom surface and the side walls of the vessel so that stream is able to flow from every direction into the tube nest at a reduced steam velocity. The extracting opening is disposed below the center of gravity of the outer circumference, and the plurality of flow passages extend from the outer circumference toward the extracting opening. Each flow passage has open outer end on the outer circumference and the width of each flow passage increases toward the open outer end. The area ratio and the length of the flow passage increase toward the center axis of the tube nest. The result is a compact condenser capable of reducing pressure loss and of efficiently removing noncondensable gas.

6 Claims, 15 Drawing Sheets

CONDENSER AND POWER PLANT

BACKGROUND OF THE INVENTION

The present invention relates to a condenser and, more particularly, to a condenser suitable for use as a condenser in a nuclear power plant, a thermal power plant or a chemical plant.

For example, a steam condenser installed in a nuclear power plant or a thermal power plant is provided with a water chamber at the opposite ends of cooling tubes, and a steam inlet formed so that steam flows perpendicularly to the cooling tubes. Since the tube nest of a general steam condenser has 1,000 to 10,000 cooling tubes, the pressure loss due to the drag of the cooling tubes against the flow of steam is a significant problem in causing steam flow into the interior of the tube nest.

On the other hand, steam contains noncondensable gases, such as air, and the noncondensable gases collect in a low-pressure region of the tube nest as steam condenses into water. The noncondensable gases stagnating within the tube nest tend to cover the surfaces of the cooling tubes and to impede the condensation of the steam. Accordingly, the effective removal of the noncondensable gases is also a significant problem.

Pressure loss caused by the tube nest and the noncondensable gas stagnating region are dependent on the steam flow, which in turn is greatly dependent on the shape of the cross section of the tube nest perpendicular to the cooling tubes. Tube respectively having various shapes have been proposed in an effort to alleviate the problems.

A tube nest of a first prior art arrangement, as disclosed in Japanese Patent Laid-Open No. Sho 61-114087 (1986), U.S. Pat. No. 1,704,484 and DE No. 7,539,721, has flow passages formed in the outer circumference thereof to reduce pressure loss, and an air passage area through which noncondensable gases are guided to an extracting tube or an extracting opening (hereinafter referred to as an "extracting region").

Although these tube nests differ from each other in shape, each of the cooling tubes of those tube nests are arranged in layers of a fixed thickness around the air passage area based on the following common concept. That is, when the cooling tubes are arranged in layers perpendicular to the direction of uniform flow of inflowing steam, steam flows one-dimensionally and condenses on the surface of the layer, and noncondensable gases are guided to the extracting tube by the air passage area formed behind the back side of the layer. Since the surface area of the tube nest is limited by the width of the steam inlet and pressure loss increases, the shape is deformed two-dimensionally without changing the thickness of the layer.

A tube nest of a second prior art arrangement, as disclosed in Japanese Patent Laid-Open No. Hei 4-244589 (1992), has a shape having a plurality of flow passages formed in a layer and having a width decreasing in an arithmetical progression to collect noncondensable gases in a low-pressure region.

A tube nest of a third prior art arrangement, as in Japanese Patent Laid-Open No. Hei 2-242088 (1990), has a layer divided into a plurality of dividual tube nests by flow passages, and the sectional area of one flow passage is varied to collect noncondensable gases in a low-pressure region.

In the first prior art arrangement, noncondensable gases do not necessarily collect in the air passage area behind the layer when the shape of the tube nest is deformed two-dimensionally, and the air passage area does not function effectively when the noncondensable gas stagnates in a region separated from the extracting region. Further, since the velocity of the steam flow in the tube nest having the air passage area is low, the air passage area does not reduce the pressure loss effectively.

In the second and third prior art arrangements, flow passages are necessary to collect the noncondensable gases in the low-pressure region. But since the cooling tubes cannot be disposed in the flow passages, these prior art arrangements are not suitable for a compact steam condenser. Since the different steam passes have different noncondensable gas concentrations, the noncondensable gases mix in the low-pressure region and the stagnating region of the noncondensable gas cannot be reduced to a satisfactory extent. Furthermore, the second prior art has difficulty in collecting noncondensable gases in the direction of the flow passages when the length of the flow passages is long. The third prior art arrangement needs additional equipment because it needs spaces for providing extracting systems respectively with the individual tube nests. Those problems in the prior art are attributable to the shape of the tube nest designed on the basis of the one-dimensional theory.

SUMMARY OF THE INVENTION

It is an object of the present invention to provide a compact condenser capable of reducing pressure loss and of efficiently removing noncondensable gas, and to provide a power plant employing the condenser.

With the foregoing object in view, in a first aspect of the present invention, a condenser comprises a steam inlet through which steam is received, a plurality of cooling tubes for condensing the steam received through the steam inlet, a condensate outlet through which condensate produced by the cooling tubes is discharged, and at least one extracting means through which noncondensable gases contained in the steam are extracted, and is characterized in that a steam suction region is formed around the extracting means, and the cooling tubes are arranged so as to substantially equalize, at least in the direction of the main flow of the steam, flow rate distribution (or sectional area distribution of a plurality of regions) defined by the shape of the suction region and the stream lines of suction flow flowing toward the extracting means.

In a second aspect of the present invention, a condenser comprises a steam inlet through which steam is received, a tube nest comprising a plurality of cooling tubes for condensing steam received through the steam inlet and at least one extracting means through which noncondensable gases contained in steam are extracted, and a condensate outlet through which condensate produced by the cooling tubes is discharged, and is characterized in that the extracting and the steam inlet are disposed on the opposite sides, respectively, of center of gravity of the outer circumference of the tube nest, the tube nest has a plurality of flow passages extending from the outer circumference of the tube nest toward the extracting means, and the length of the flow passages nearer to a reference line parallel to the direction of the main flow of the steam and extending between the extracting means and the steam inlet is longer.

In a third aspect of the present invention, a condenser comprises a steam inlet through which steam is received, a tube nest comprising a plurality of cooling tubes for condensing steam received through the steam inlet and at least one extracting means through which noncondensable gases contained in steam are extracted, and a condensate outlet through which condensate produced by the cooling tubes is discharged, and is characterized in that the tube nest has a first region located on the side of the steam inlet and having a plurality of flow passages extending from the circumference of the tube nest toward the extracting means, and a second region adjacent to the first region including the extracting means and having cooling tubes in a dense arrangement, and the length of the flow passages nearer to a reference line parallel to the direction of the main flow of the steam and extending from the extracting toward the steam inlet means is longer.

In a fourth aspect of the present invention, a condenser comprises a steam inlet through which steam is received, a tube nest comprising a plurality of cooling tubes for condensing steam received through the steam inlet and at least one extracting means through which noncondensable gases contained in steam are extracted, and a condensate outlet through which condensate produced by the cooling tubes is discharged, and is characterized in that the tube nest has a massed region in which the cooling tubes are arranged densely around the extracting means, and a radial region having a plurality of flow passages extending from the circumference of the tube nest toward the extracting means, and the flow passages are formed to substantially equalize the flow rate of the steam flowing into each flow passage.

In a fifth aspect of the present invention, a power plant comprises a steam turbine using steam for power generation, and a steam condenser for condensing steam discharged from the steam turbine, in which the steam condenser is the condenser according to any one of the first, the second and the third aspects of the present invention.

The present invention optimizes the respective positions of flow passages and an extracting region in a tube nest on the basis of a two-dimensional theory that expresses the two-dimensional shape of the tube nest of a condenser. The principle of the present invention will be described in connection with a steam condenser intended for use in a nuclear power plant or a thermal power plant. In a nuclear power plant or a thermal power plant, steam flows through passages between the vanes of a turbine rotors and an exhaust chamber into a steam condenser, and the steam condenses in the tube nest of the steam condenser. Therefore, steam flows in a complex flow distribution in the steam inlet of the steam condenser. Generally, the turbine exhaust chamber is formed in a construction to reduce channeling in the steam inlet of the steam condenser. Therefore, the following description will be provided on an assumption that steam flows uniformly in the steam inlet of the steam condenser.

FIG. 3 is a conceptional diagram showing a model of suction flow as a basis of the two-dimensional theory. Steam condenses on the surfaces of the plurality of cooling tubes of a tube nest. Consider a suction flow obtained by replacing condensation on the surface of the cooling tube with suction in an extracting region where noncondensable gases contained in steam are collected. Since the flow in the stream inlet is uniform as indicated by the stream lines arranged at equal intervals in FIG. 3, all the flow rates between the adjacent stream lines will be equal to each other.

Referring to FIG. 4, a cooling tube installing area necessary for condensing the flow rates between the stream lines is shown. The surface integral from a suction point of each of the sections between adjacent stream lines is calculated to determine a shape having a fixed area, and an envelope (equiareal line) is determined by connecting the end points. For example, the respective areas of two shaded sections in FIG. 4 are equal to each other. The equiareal line can be determined by either a graphical method or a mathematical method. When determining the equiareal line by a mathematical method, one of the variables of surface integration is selected as a stream function corresponding to the stream line, and one variable can be determined as a stream potential perpendicular to the stream line.

Different cooling tubes have a different condensing capacity, and the condensing capacity of a cooling tube is dependent on the temperature of the saturated steam and on the steam velocity, which decrease with an increase of pressure loss in the tube nest, and on the heat transfer rate which is dependent on the noncondensable gas concentration. Since the final object is to reduce the pressure loss and to remove noncondensable gases, and since heat transfer rate is dominated by a liquid film covering the surface of the cooling tube and is scarcely affected by the steam velocity when the noncondensable gas concentration of the steam is very small, it is possible to assume that the condensing capacities of the cooling tubes are equal to each other. Therefore, since a certain number of cooling tubes are necessary to condense steam flowing at a certain velocity, the previously determined cooling tube installing area is that necessary for densely installing cooling tubes in a regular staggered arrangement or in-line arrangement, and since the equiareal line represents the external shape of the tube nest. This tube nest will be designated hereinafter as a massed tube nest.

When a large steam condenser is provided with a massed tube nest, pressure loss in the steam condenser is large and steam is unable to reach the central portion of the tube nest. Therefore, a tube nest with flow passages is necessary. FIG. 5 shows a method of the forming flow passages in a massed tube nest. Flow passages are formed along stream lines by shifting some of tube bundles in the massed tube nest outside the massed tube nest to reduce drag against the suction flow. The tube bundles are shifted outside the massed tube nest so that the respective numbers of the cooling tubes in sections between the adjacent stream lines are equal to each other to equalize steam condensing rates in the sections between the adjacent stream lines, i.e., to equalize the respective areas of the tube bundles in sections between the adjacent stream lines.

Although the intervals between the stream lines are optional, it is necessary to reduce the intervals so as to maintain substantially the general shape of the tube nest, that is the distribution of the cooling tubes. However, the intervals cannot be reduced below the pitches of the tube bundles and the friction of the surfaces of the cooling tube facing the flow passages increases when the intervals between the stream lines are reduced and a plurality of flow passages are formed. With those points in view, it is appropriate to divide the tube nest into sections of about ten stream lines, as shown in FIG. 5.

The velocity of steam on the outer circumference of a massed tube nest is not uniform and is inversely proportional to the intervals between the stream lines. Therefore, the velocity of steam is higher in the upper part of a narrower section, and the velocity of steam in upper parts near to the center axis, i.e., a reference line parallel to the main stream and extending from the extracting region to the steam inlet, is higher. Since pressure loss varies in proportion to the square of the velocity of the steam, flow passages are formed in the upper parts where the velocity of the steam is high and the ratio of the flow passage between the stream lines nearer to the center axis is increased in proportion to the velocity of the steam. Since a fixed interval between the stream lines is a basic condition, the length of the flow passages nearer to the center axis is longer, and the height of the upper ends of the tube bundles nearer to the center axis is higher. Pressure loss is produced in the upper part of the tube nest because the stream lines are deformed by the drag of the tube bundle. Nevertheless, the pressure loss can be reduced by arranging the tube bundle to have a lower density because the deformation of the stream lines can be limited to the least extent.

Suppose that the flow passages are extended near to a region around the suction point. Generally, tubes of the tube bundles of a steam condenser are arranged regularly in a staggered arrangement or in-line arrangement. However, it is difficult to form flow passages along curved stream lines of suction flow by regular tube bundles in which tubes are arranged regularly. Therefore, flow passages are extended linearly, as shown in FIG. 6.

The shapes of the flow passages define actual stream lines. FIG. 6, similar to the above-mentioned drawing, shows ideal stream lines of suction flow. In FIG. 6, indicated at 13*a* to 13*m* are tube bundles for condensing steam flowing at a fixed flow rate in sections between the stream lines. Since the quantity of steam flowing at the fixed flow rate does not change even if the flow passages are extended, the areas of the tube bundles 13*a* to 13*m* are fixed. Since it is difficult to dispose the tube bundles along the ideal stream lines of suction flow in the upper portion of the tube nest in which the flow passages are formed, the flow passages are approximated by outwardly extending convex polygonal lines, as shown in FIG. 6, and the tube bundles are arranged along the flow passages approximated by the outwardly extending convex polygonal lines.

Although the flow is not regulated by flow passages in the lower portion of the tube nest in which no flow passage is formed, the tube bundles are dislocated outside the equiareal line to fix the area of each tube bundle because the upper tube bundles are shifted to the lower portion when the upper portion of the tube nest is deformed. The velocity of flow is very low and the influence of the shapes of the tube bundles on pressure loss is insignificant in the lower portion of the tube nest when the tube bundles are arranged in the above-mentioned arrangement.

The shape of the tube nest thus determined forms flow passages that enable the condensation of steam without disturbing steam streams inflowing into the upper portion of the tube nest, whereby pressure loss can be reduced. Since the noncondensable gases can be collected at the suction point at the end of suction flow, the noncondensable gases can be efficiently removed to enhance the heat transfer performance greatly. Since the condenser does not have any air passage area, the steam condenser can be formed in a compact construction.

DETAILED DESCRIPTION OF THE PREFERRED EMBODIMENTS

Figure 2:
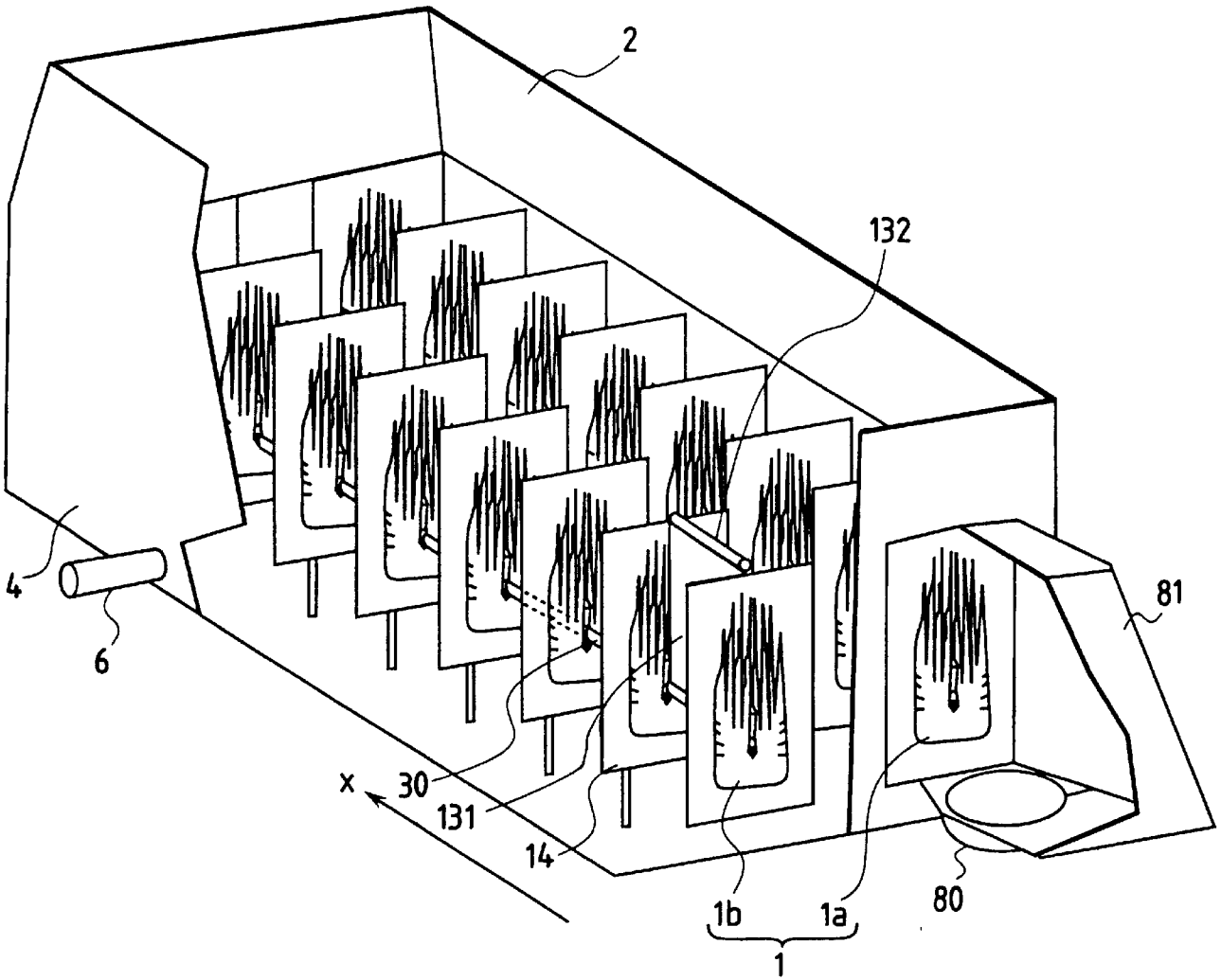
FIG. 2 is a schematic partly cutaway perspective view of a steam condenser to which the present invention is applied.
Figure 3:
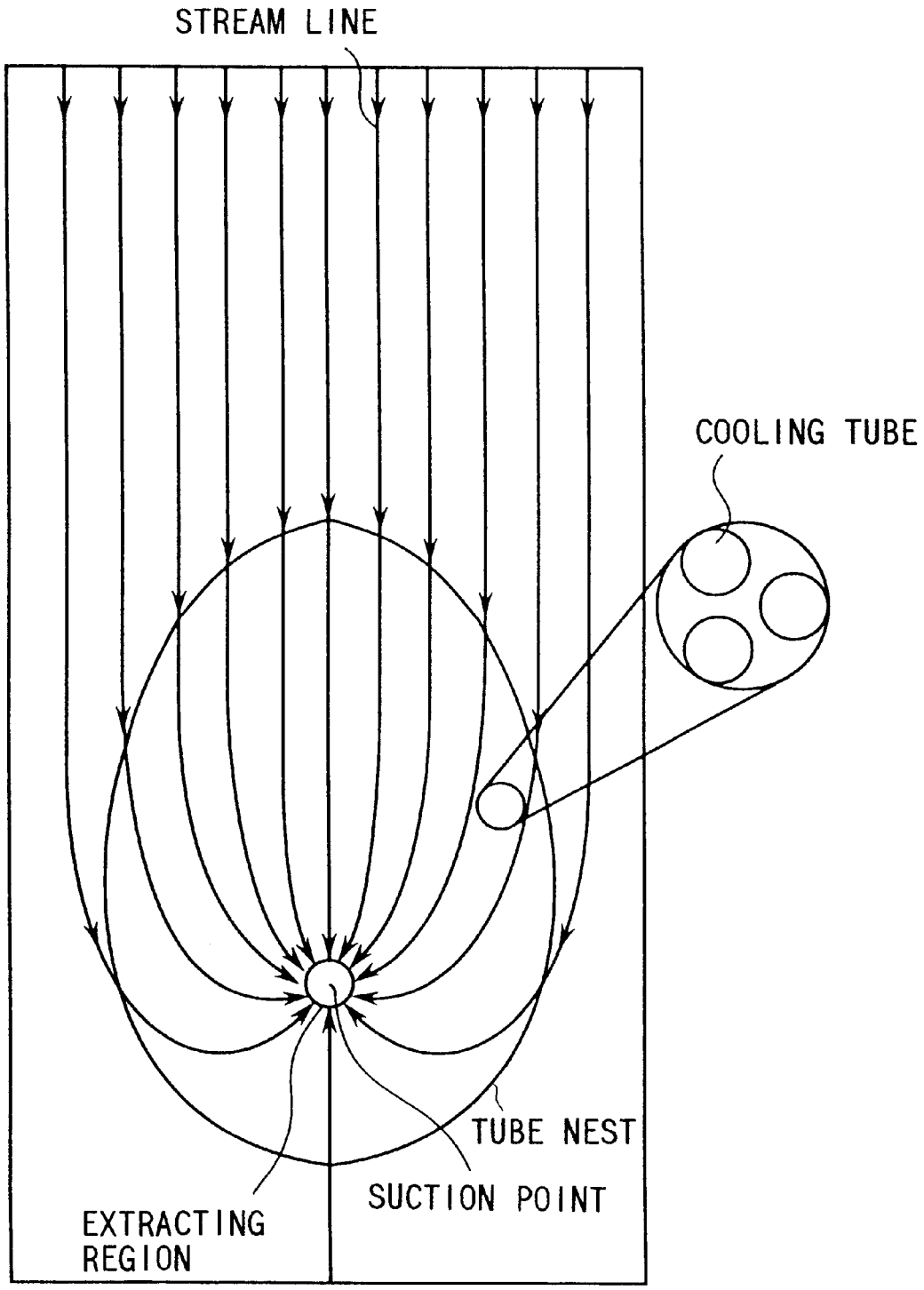
FIG. 3 is a diagrammatic view of a model of suction flow, illustrating the principle of the present invention.
Figure 4:
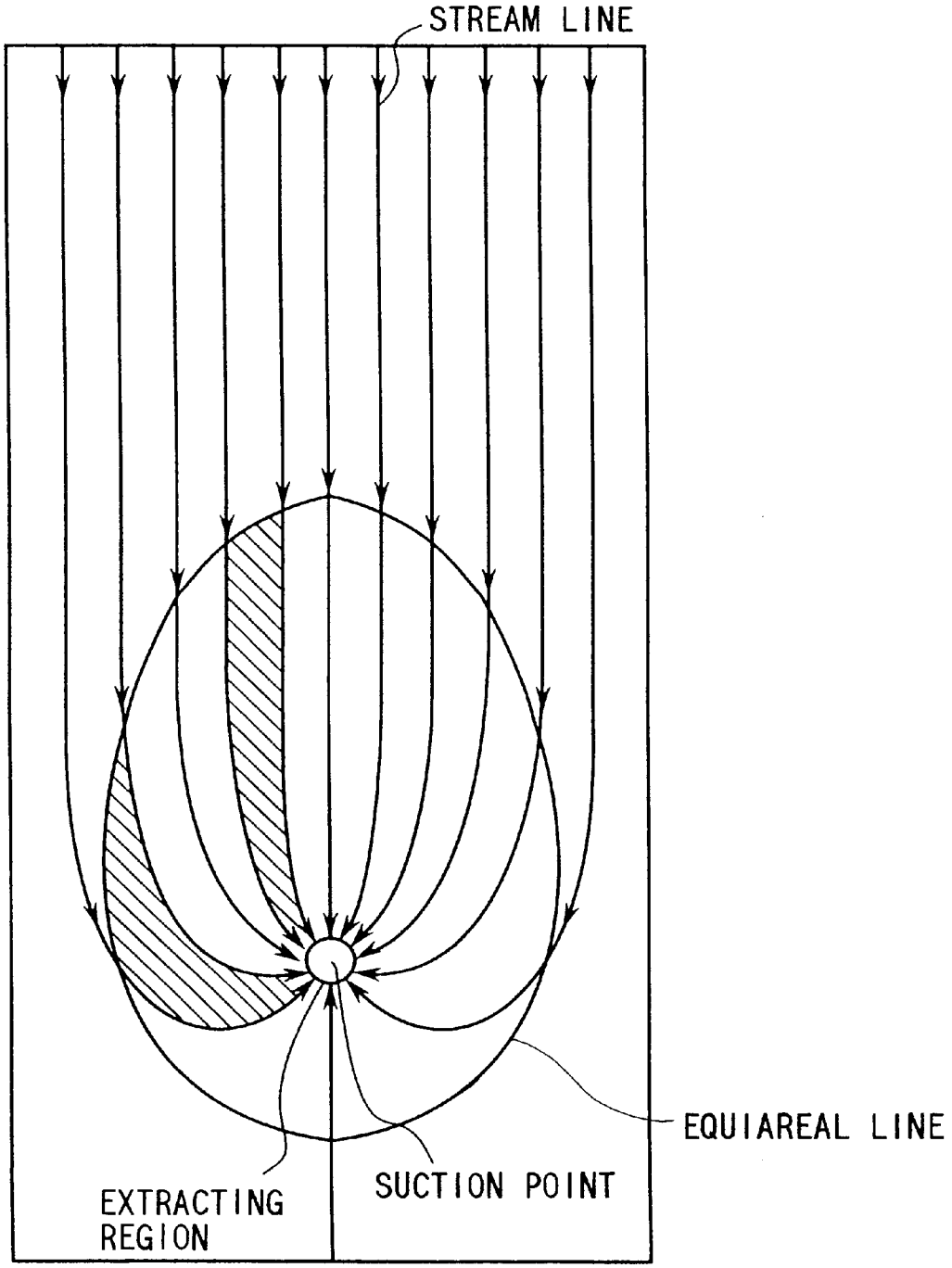
FIG. 4 is a diagrammatic view of a model of suction flow, illustrating the principle of the present invention.

Preferred embodiments of the present invention will be described hereinafter with reference to the accompanying drawings. FIG. 2 shows a steam condenser embodying the present invention, having a steam inlet 2, a tube nest 1 for condensing steam, a noncondensable gas extracting tube 30 through which noncondensable gases are extracted, a condensate outlet tube 6 and a condensing vessel having side walls 4. The tube nest 1 comprises 1000 to 10000 cooling tubes, not shown, horizontally extending in the x direction and supported by support plates 140. Cooling water flows through a cooling water inlet 80 into a water box 81, and then flows through the cooling tubes of the tube nest 1. The tube nest 1 has two tube nest units 1*a* and 1*b* so that the tube nest 1 is able to function properly even if either the tube nest unit 1*a* or 1*b* fails to function properly.

Steam discharged from a turbine, not shown, flows through the steam inlet 2 into the steam condenser, the steam is condensed by the tube nest 1, and the condensate thus produced is caused to flow down by the force of gravity and is discharged through the condensate outlet 6. The steam that could not be condensed by the tube nest 1 and noncondensable gases are sucked into the perforated extracting tube 30 extending in the x direction and flow into a noncondensable gas cooling unit 131 disposed at one end of the extracting tube 30. The noncondensable gas cooling unit 131 is provided internally with a plurality of cooling tubes extending in the x direction. Most of the uncondensed steam is condensed by the cooling tubes of the noncondensable gas cooling unit 131, and the noncondensable gases are discharged outside of the steam condenser through a noncondensable gas discharge tube 132. The noncondensable gas cooling unit 131 condenses the steam that could not be condensed by the tube nest 1.

The noncondensable gas cooling unit 131 may extend through the entire length along the x direction or the extracting tube 30 may be extend outside the steam condenser and be connected to a noncondensable gas cooling unit 131 disposed outside the steam condenser.

Figure 7:
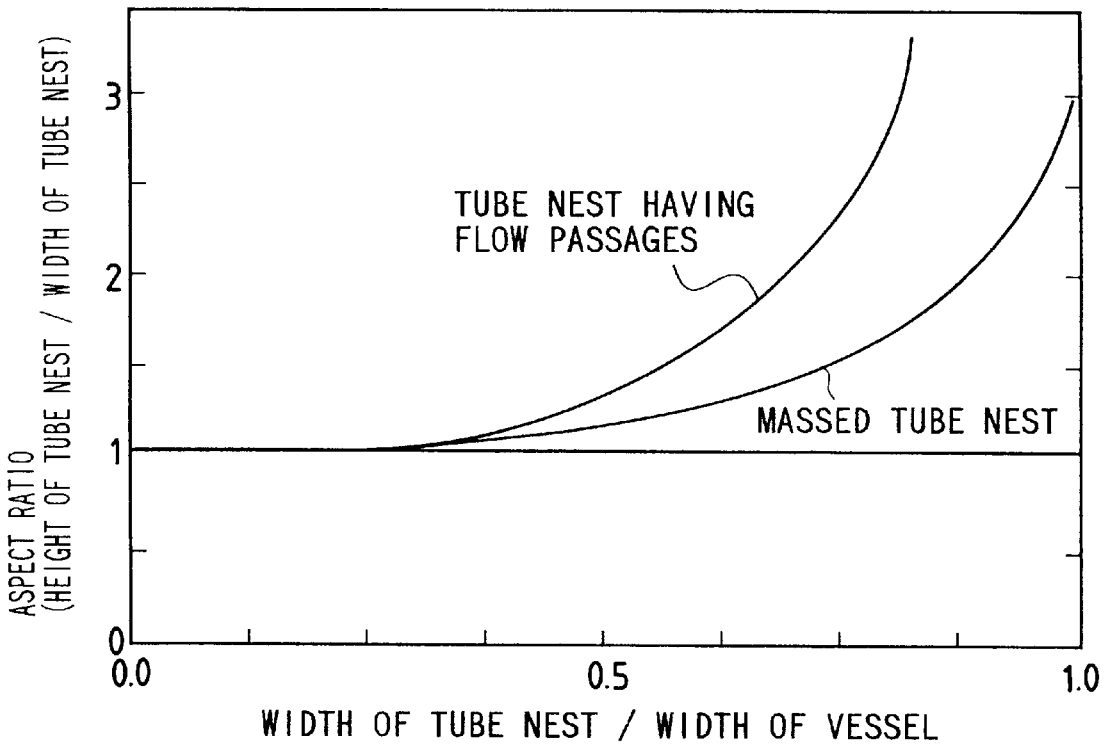
FIG. 7 is a graph showing the relation between the width of a vessel and the aspect ratio of a tube nest determined through the analysis of a model of suction flow.

A method of determining the aspect ratio of the tube nest, i.e., the ratio of the height of the tube nest to the width of the tube nest, will be described below with reference to FIG. 7 which shows curves determined by the aforesaid suction theory. In FIG. 7, the vertical axis indicates the aspect ratio and the horizontal axis indicates the width ratio, i.e., the ratio of the width of the tube nest to that of the vessel. When two tube nest units are installed in the vessel, as shown in FIG. 2, the width of the vessel is the distance between the side wall 4 and a plane with respect to which the two tube nest units are symmetrical. In FIG. 7, the upper curve is for a tube nest having flow passages and the lower curve is for a massed tube nest. The aspect ratio of the tube nest in relation with the width of the vessel can be determined by using the curves shown in FIG. 7, which have been determined on the basis of the suction theory.

Figure 5:
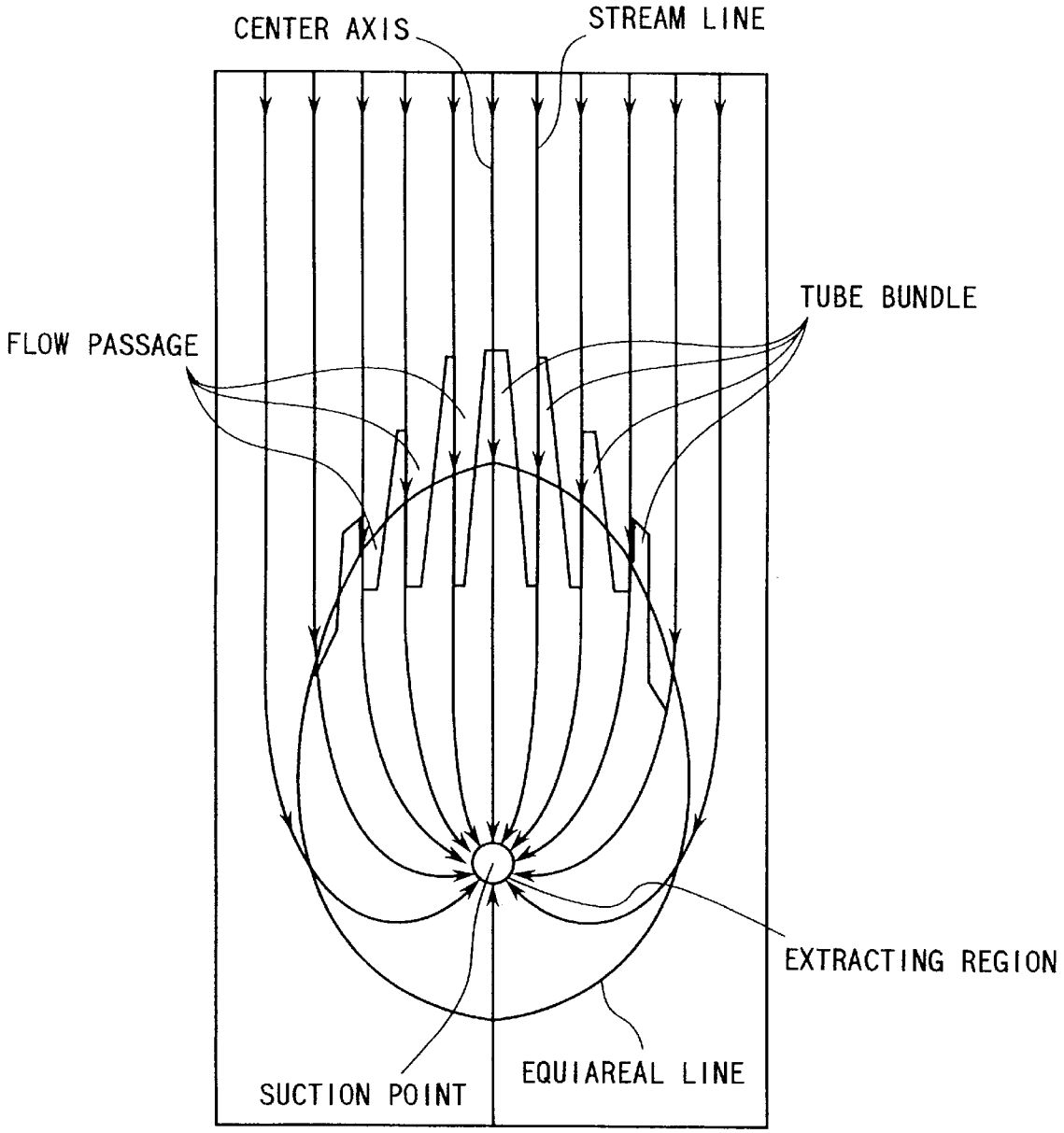
FIG. 5 is a diagrammatic view of a model of suction flow, illustrating the principle of the present invention.
Figure 6:
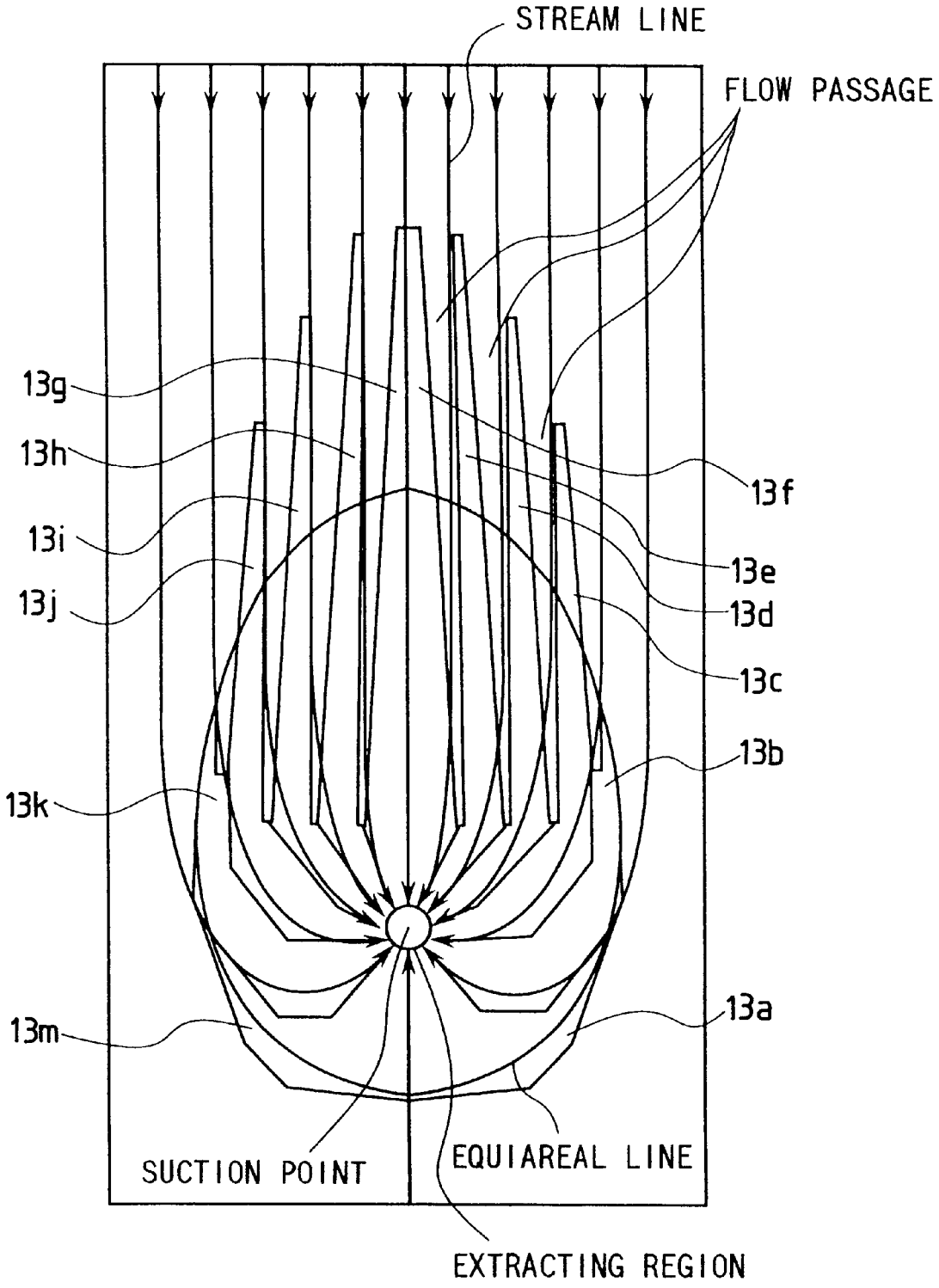
FIG. 6 is a diagrammatic view of a model of suction flow, illustrating the principle of the present invention.

For example, since the influence of the side walls of the vessel is insignificant when the width of the tube nest is very small as compared with the width of the vessel, the shape of the massed tube nest approaches concentric circles and the aspect ratio of the massed tube nest is approximately 1. Since the distribution (or irregularity) in the steam velocity on the outer circumference of the massed tube nest is small, it is preferable to form flow passages in a uniform circumferential arrangement to maintain the balance of pressure loss and to reduce the pressure at the suction point. Under these conditions, the aspect ratio of the tube nest having flow passages is also approximately 1. When the width ratio is greater than 0.5, the influence of the side walls of the vessel become significant and the aspect ratio of the massed tube nest is greater than 1. In this case, the distribution of the steam velocity on the outer circumference of the massed tube nest increases and the steam velocity in the upper portion increases. Therefore, the rate of increase of the aspect ratio of the tube nest having flow passages must be greater than that of the aspect ratio of the massed tube nest to form flow passages using the method previously described with reference to FIGS. 5 and 6.

An optimum aspect ratio for the tube nest having flow passages will be explained. As mentioned above, the influence of the walls of the vessel become significant when the width of the tube nest is comparatively large as compared with the width of the vessel and, consequently, the steam velocity becomes irregular and the aspect ratio of the massed tube nest is determined. Accordingly, the aspect ratio of the massed tube nest can be used as an index denoting the distribution of steam velocity. In the following description, the upper region of the tube nest in which flow passages are formed will be designated as a "radial region".

The steam velocity in the upper portion of the tube nest is considered to vary substantially in proportion to the aspect ratio of the massed tube nest. The pressure loss is proportional to the drag coefficient of the tube nest and the square of the steam velocity. Therefore, the drag coefficient of the upper portion of the tube nest must be inversely proportional to the square of the steam velocity to suppress pressure loss in the upper portion of the tube nest to the level of the pressure loss in the lower portion of the tube nest. That is, the drag coefficient of the upper portion of the tube nest must be inversely proportional to the square of the aspect ratio of the massed tube nest.

Therefore, the number of the cooling tubes is fixed, the area of the radial region is increased in proportion to the square of the aspect ratio of the massed tube nest so that the occupancy of the cooling tubes in the radial region is inversely proportional to the square of the aspect ratio of the massed tube nest. Since the drag coefficient of the upper portion of the tube nest is proportional to the occupancy of the cooling tubes in the radial region, the drag coefficient of the upper portion of the tube nest can be reduced in inverse proportion to the square of the aspect ratio of the massed tube nest. When the ratio of the radial region in the tube nest having flow passage is large, it is preferable that the aspect ratio of the tube nest having flow passages is equal to the square of the aspect ratio of the massed tube nest.

The foregoing explanations are qualitative and the optimum value must have an appropriate allowance. FIG. 7 shows a case wherein the aspect ratio of the tube nest having flow passages is equal to the square of the aspect ratio of the massed tube nest.

Practically, there are restrictions on the width of the vessel connected with the installation of the vessel. If the width of the vessel is very small and the aspect ratio of the tube nest is very large, the distribution of the steam velocity on the outer circumference of the tube nest increases greatly and it is difficult to ensure a uniform pressure loss even if a radial region is formed. Therefore, a preferable width ratio, i.e., the ratio of the width of the tube nest to that of the vessel, is in the range of about 0.5 to about 0.8, which corresponds to a range of 1.13 to 1.75 for the aspect ratio of the massed tube nest and a range of 1.28 to 3.06 for the aspect ratio of the tube nest having flow passages. Since a comparatively small steam condenser has a comparatively small number of cooling tubes, the aspect ratio of the tube nest may be less than 1.

A tube nest in accordance with the present invention, provided with a suction point and having an aspect ratio greater than 1, and a tube nest in accordance with the present invention having an aspect ratio smaller than 1, will be described below.

Figure 1:
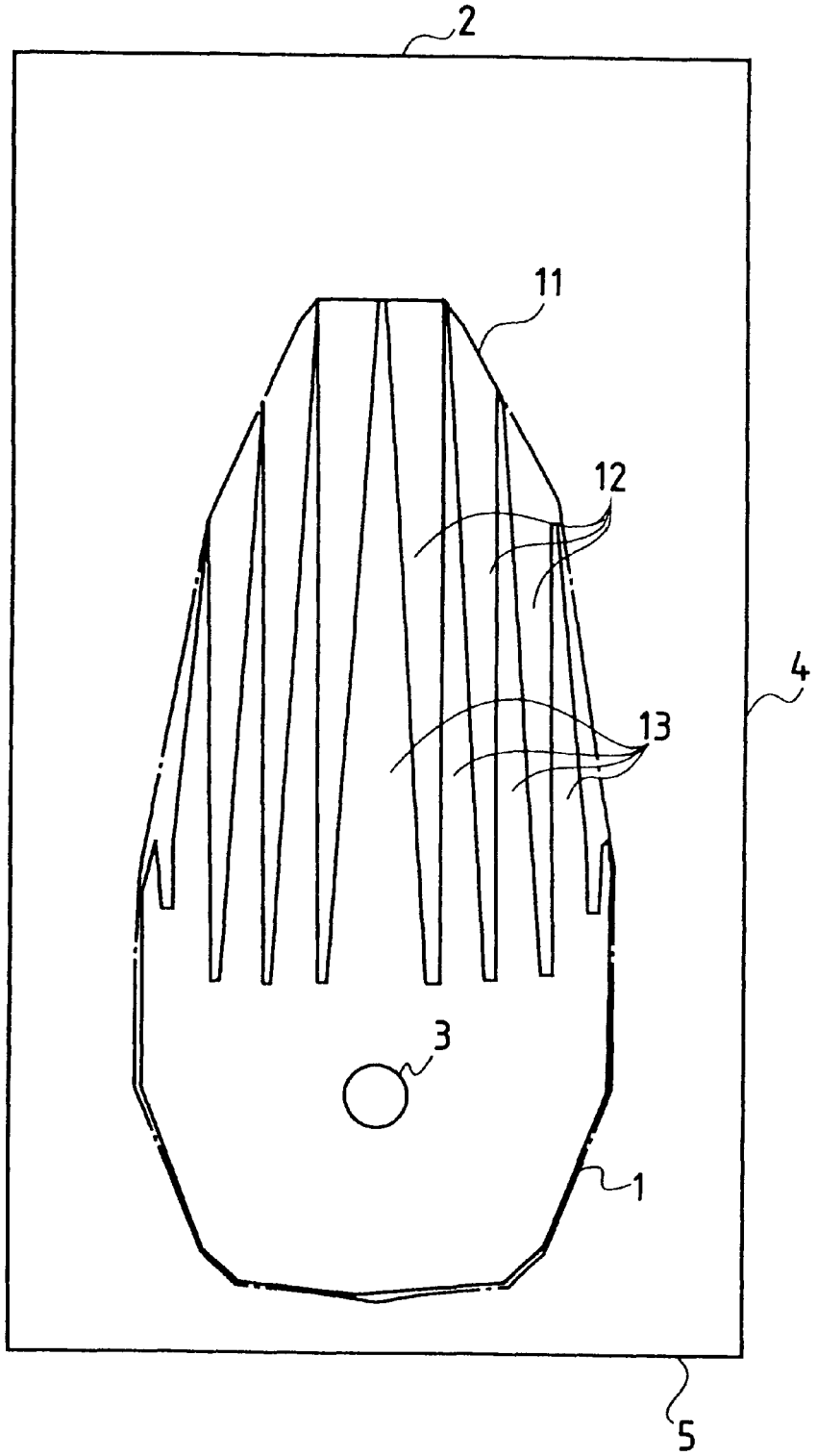
FIG. 1 is a sectional view of a tube nest in a first embodiment according to the present invention.

FIG. 1 shows, in a sectional view, a tube nest 1 forming in a first embodiment according to the present invention, having flow passages 12, tube bundles 13 and a noncondensable gas extracting opening 3. Indicated at 11 is the outer circumference of the tube nest 1, at 2 is a steam inlet and at 5 is the bottom surface of the vessel. When only one tube nest unit is disposed in the vessel, indicated at 4 are the side walls of the vessel. When two tube nest units are disposed in the vessel, indicated at 4 are the side wall of the vessel and a plane with respect to which the two tube nest units are symmetrical. The shape of the tube nest shown in FIG. 1 is the same as that determined by the method described with reference to FIG. 6, and the extracting opening 3 is disposed at the suction point.

The tube nest 1 is spaced from the bottom surface 5 and the side walls 4 of the vessel so that steam can flow from every direction into the tube nest 1 and the steam velocity can be reduced. The extracting opening 3 is disposed below the center of gravity of the outer circumference 11 of the tube nest 1, and a plurality of flow passages 12 extend from the outer circumference 11 toward the extracting opening 3. Each flow passage 12 has an open outer end on the outer circumference 11 and the width of each flow passage 12 increases toward the open outer end. That is, each flow passage 12 has an inlet on the outer circumference 11 and the width of each flow passage 12 decreases toward the extracting opening 3. The area ratio and the length of the flow passage increase toward the center axis of the tube nest.

Since steam flows through the steam inlet 2 into the vessel, the steam velocity in the upper portion of the tube nest 1 is comparatively high. Since the area ratio of the flow passages is greater in the upper portion where steam velocity is higher, pressure loss can be reduced. Since the extracting opening 3 is disposed at a suction point in which noncondensable gases contained in the steam collect, the noncondensable gases do not stagnate.

Figure 8:
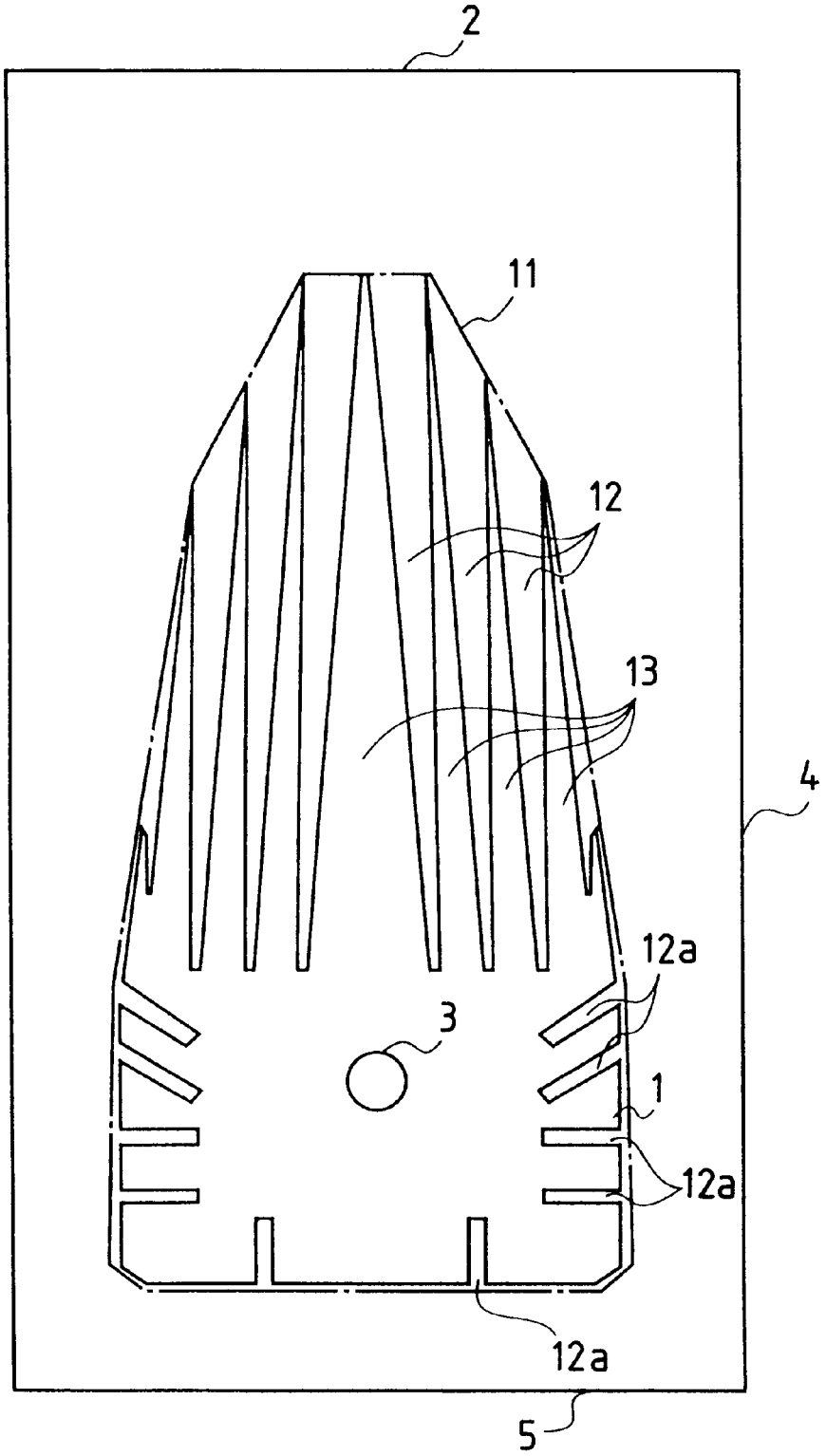
FIG. 8 is a sectional view of a tube nest in a second embodiment according to the present invention.

A tube nest 1 forming in a second embodiment according to the present invention will be described with reference to FIG. 8, showing the tube nest 1 in cross section, in which parts like or corresponding to those of the first embodiment are designated by the same reference numerals. The tube nest 1 in the second embodiment is provided with auxiliary flow passages 12*a* in its lower portion. Flow passages 12 in the upper portion of the tube nest 1 where steam velocity is high are formed each for a fixed flow rate, while the lower portion of the tube nest 1 where the steam velocity is very low is provided with a plurality of short flow passages 12*a* for the fixed flow rate to reduce pressure loss in the lower portion in which tube bundles are arranged densely.

Since the steam velocity is low in the lower portion of the tube nest 1, the outer ends of the flow passages 12*a* formed in the lower portion of the tube nest 1 may be slightly expanded. In this embodiment, the flow passages 12*a* have a fixed width. Since the shape of a portion of the outer circumference 11 of the tube nest 1 in the lower portion is optional, provided that the area of each tube bundle separated by the flow passages 12*a* is substantially fixed, the lower portion of the tube nest 1 in the second embodiment is formed in a substantially rectangular shape so that the tube nest 1 can be most compactly installed in the rectangular vessel of a steam condenser.

The flow passages 12 of the tube nest 1 in the second embodiment have the following features. Each flow passage 12 is extended from the outer circumference 11 toward the extracting opening 3, the width of portions of each flow passage 12 nearer to the outer end of the flow passage 12 is greater, the area ratio and the length of the flow passages 12 nearer to a center axis above the extracting opening 3 (a center axis on the side of the steam inlet 2) are greater, and the area ratio and the length of the flow passages decrease circumferentially from the center axis above the extracting opening 3 toward a center axis below the extracting opening 3 (a center axis on the side of the bottom surface 5 of the vessel). Tube bundles 13 are densely arranged on concentric circles around the extracting opening 3. This arrangement reduces pressure loss in the lower portion of the tube nest 1 and further enhances the performance.

Figure 9:
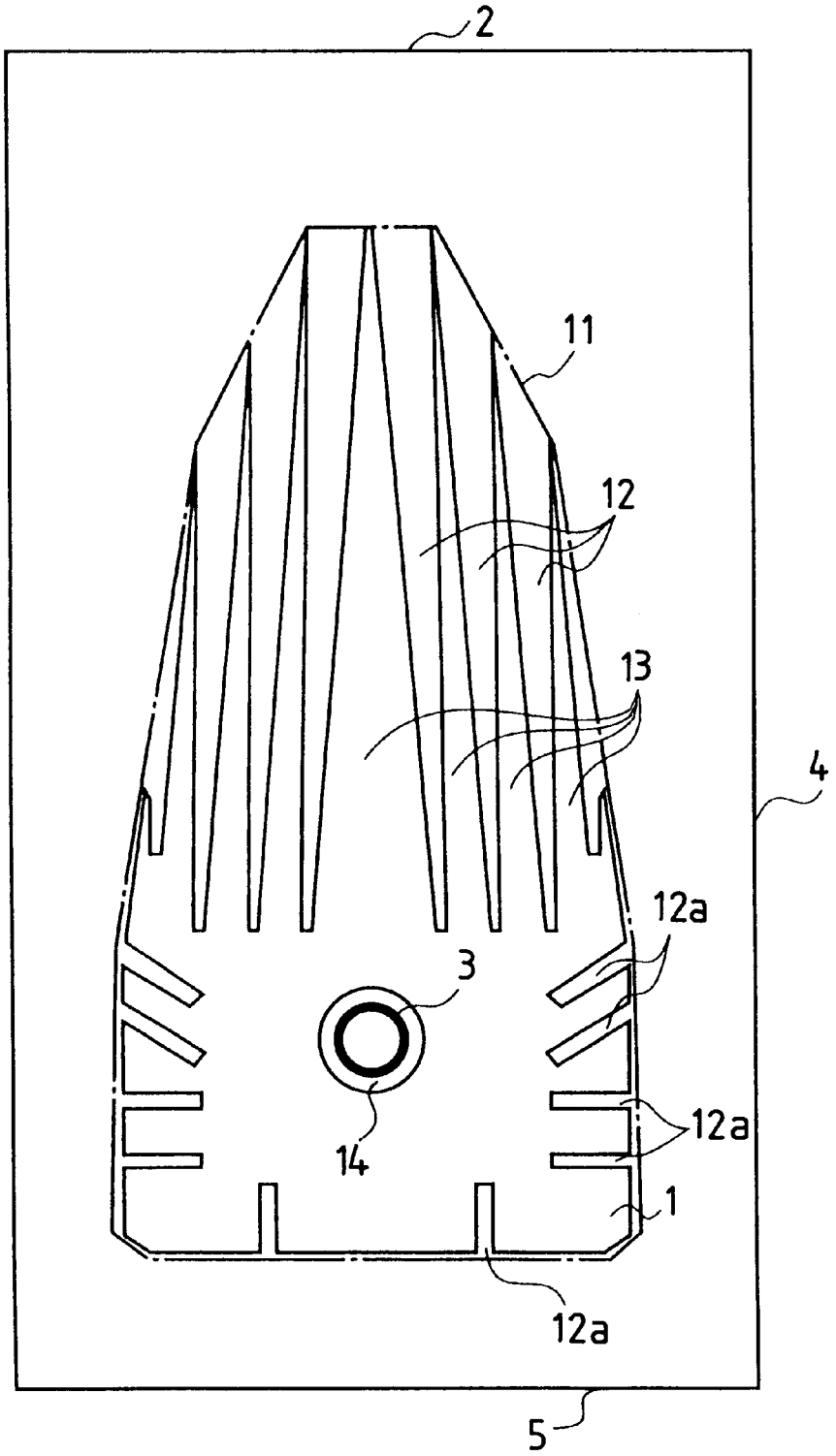
FIG. 9 is a sectional view of a tube nest in a third embodiment according to the present invention.

A tube nest 1 forming a third embodiment according to the present invention will be described with reference to FIG. 9, showing the tube nest 1 in cross section, in which parts like or corresponding to those of the second embodiment are designated by the same reference numerals. In the third embodiment, tube bundles 13 are not arranged around an extracting opening 3 and a space 14 is formed so as to surround the extracting tube 3. The space 14 is used when welding the extracting opening 3 to a support plate. Usually, a space of a width three to five times the diameter of the cooling tubes is secured around the extracting tube 3 for welding. For example, the width of the space is 9 to 15 cm when the diameter of the cooling tubes is 3 cm. The space 14 concentric with the extracting opening 3, as shown in FIG. 9, enables a steam condenser to be formed in a compact construction.

Figure 10:
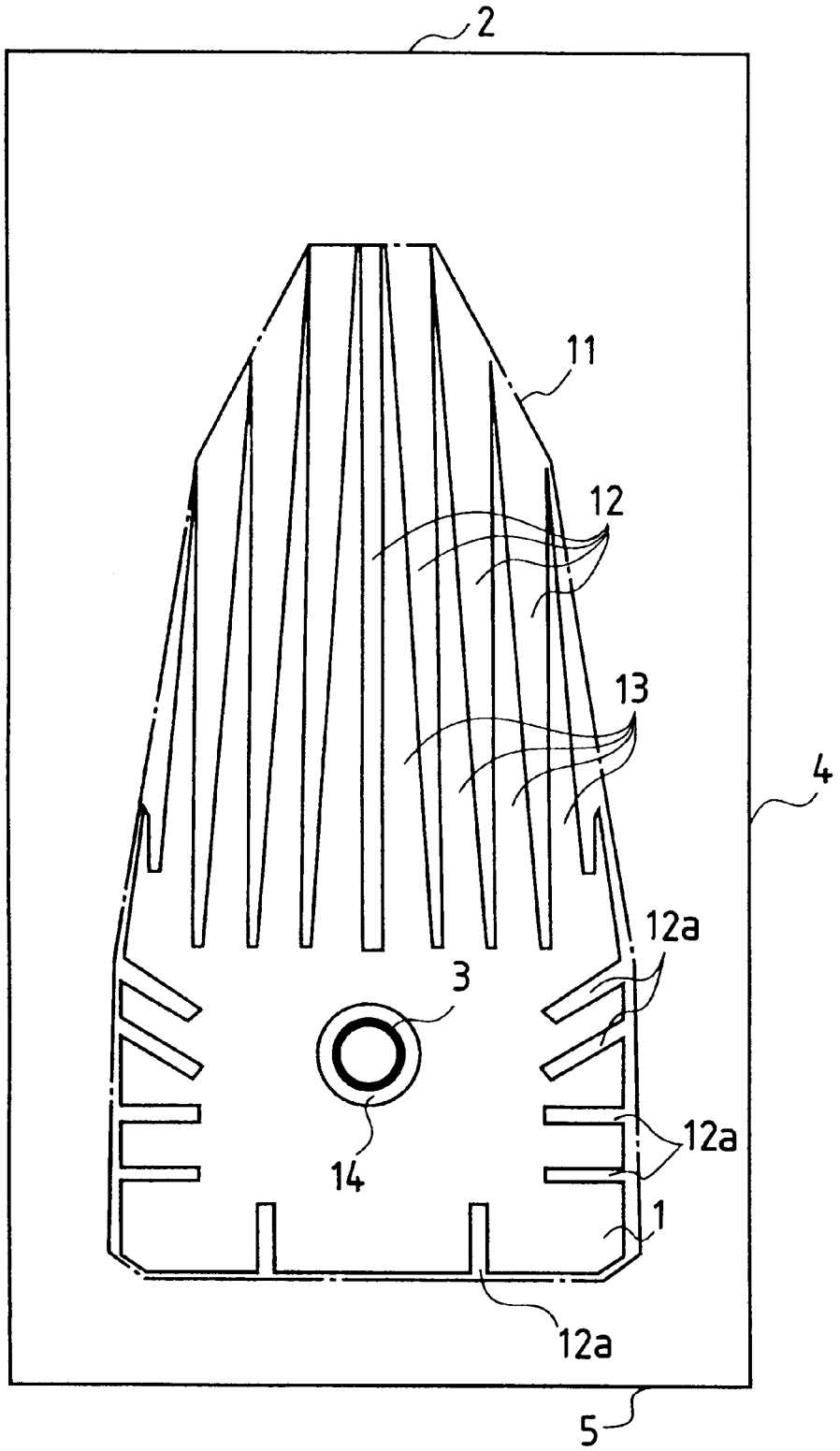
FIG. 10 is a sectional view of a tube nest in a fourth embodiment according to the present invention.

A tube nest 1 forming a fourth embodiment according to the present invention will be described with reference to FIG. 10, showing the tube nest 1 in sectional view, in which parts like or corresponding to those of the second embodiment are designated by the same reference numerals. The tube nest 1 in the fourth embodiment is provided with a flow passage 12 on a center axis on the steam inlet side above an extracting opening 3. Usually, a steam condenser is provided with a steam inlet 2 on its upper side with respect to the direction of gravity and condensate produced by condensing steam is caused to flow down by the force of gravity. Accordingly, when the flow passage 12 is formed instead of a tube bundle 13 on the center axis on the steam inlet side, the quantity of condensate that falls on the extracting opening 3 is reduced. Therefore, the extracting opening 3 does not become clogged with condensate, which ensures the extraction of noncondensable gases.

Figure 11:
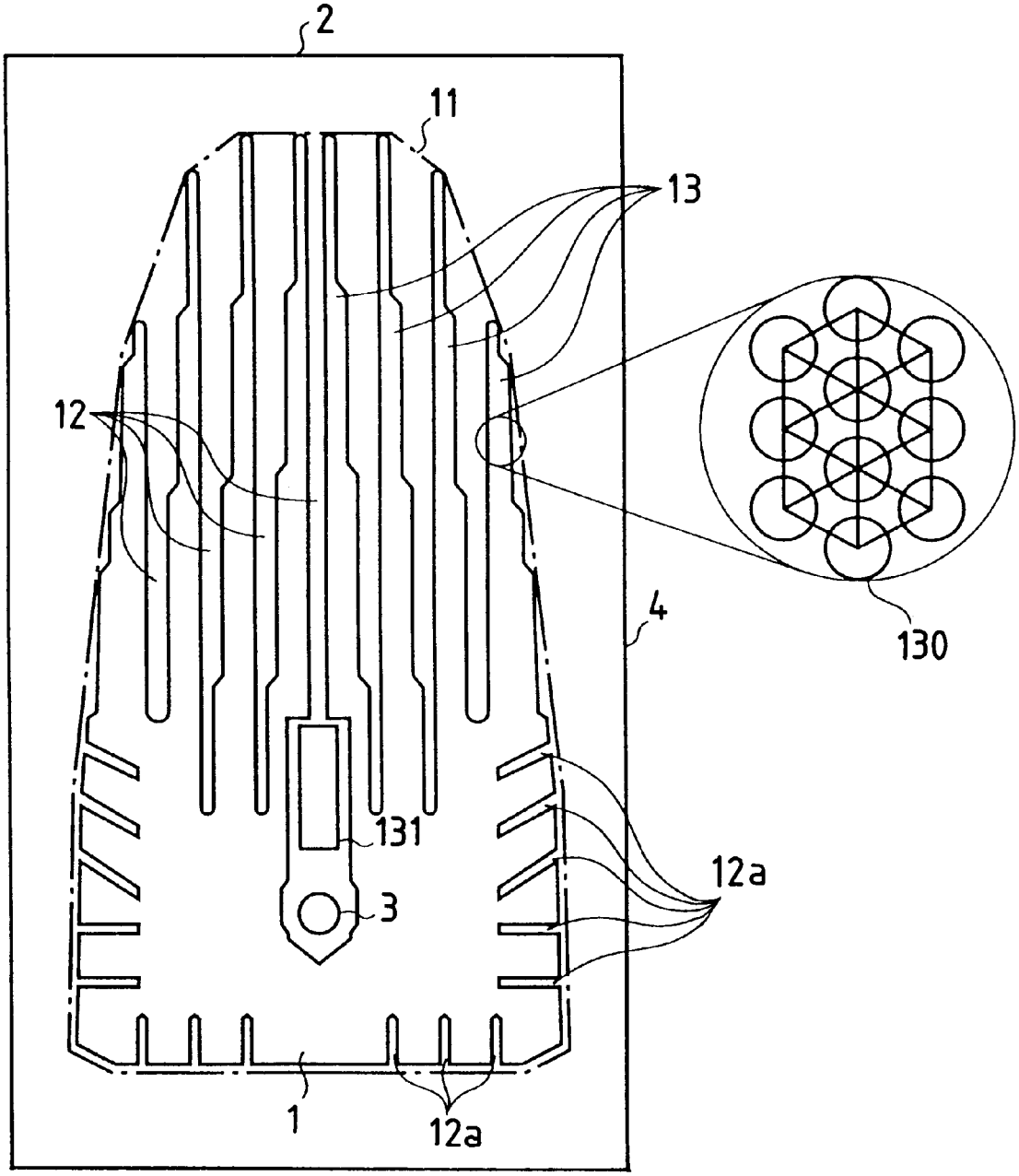
FIG. 11 is a sectional view of a tube nest in a fifth embodiment according to the present invention.

A tube nest 1 forming a fifth embodiment according to the present invention will be described with reference to FIG. 11, showing the tube nest 1 in sectional view, in which parts like or corresponding to those of the second embodiment are designated by the same reference numerals. The tube nest 1 is provided with a noncondensable gas cooling unit 131 above an extracting opening 3 to cool noncondensable gases extracted through the extracting opening 3. The noncondensable gas cooling unit 131 is provided in a region extending in the horizontal direction (the x direction in FIG. 2) to receive noncondensable gases extracted through the extracting opening 3. Noncondensable gases and uncondensed steam extracted through the extracting opening 3 flow into the noncondensable gas cooling unit 131 and are cooled therein. The uncondensed steam is condensed in the noncondensable gas cooling unit 131 and only the noncondensable gases are discharged into a noncondensable gas discharge system, not shown.

The cooling tubes 130 of each of the tube bundles 13 of this embodiment are arranged in a staggered arrangement consisting of elementary equilateral triangles to arrange the cooling tubes 130 densely and to form many flow passages. One side of each equilateral triangle defined by the cooling tubes 130 is parallel to an incident direction of steam flow (a vertical direction in FIG. 11). Therefore, flow passages with a fixed width can be formed even if the ratio of flow passages is small, which greatly contributes to forming a steam condenser having a compact construction.

Figure 12:
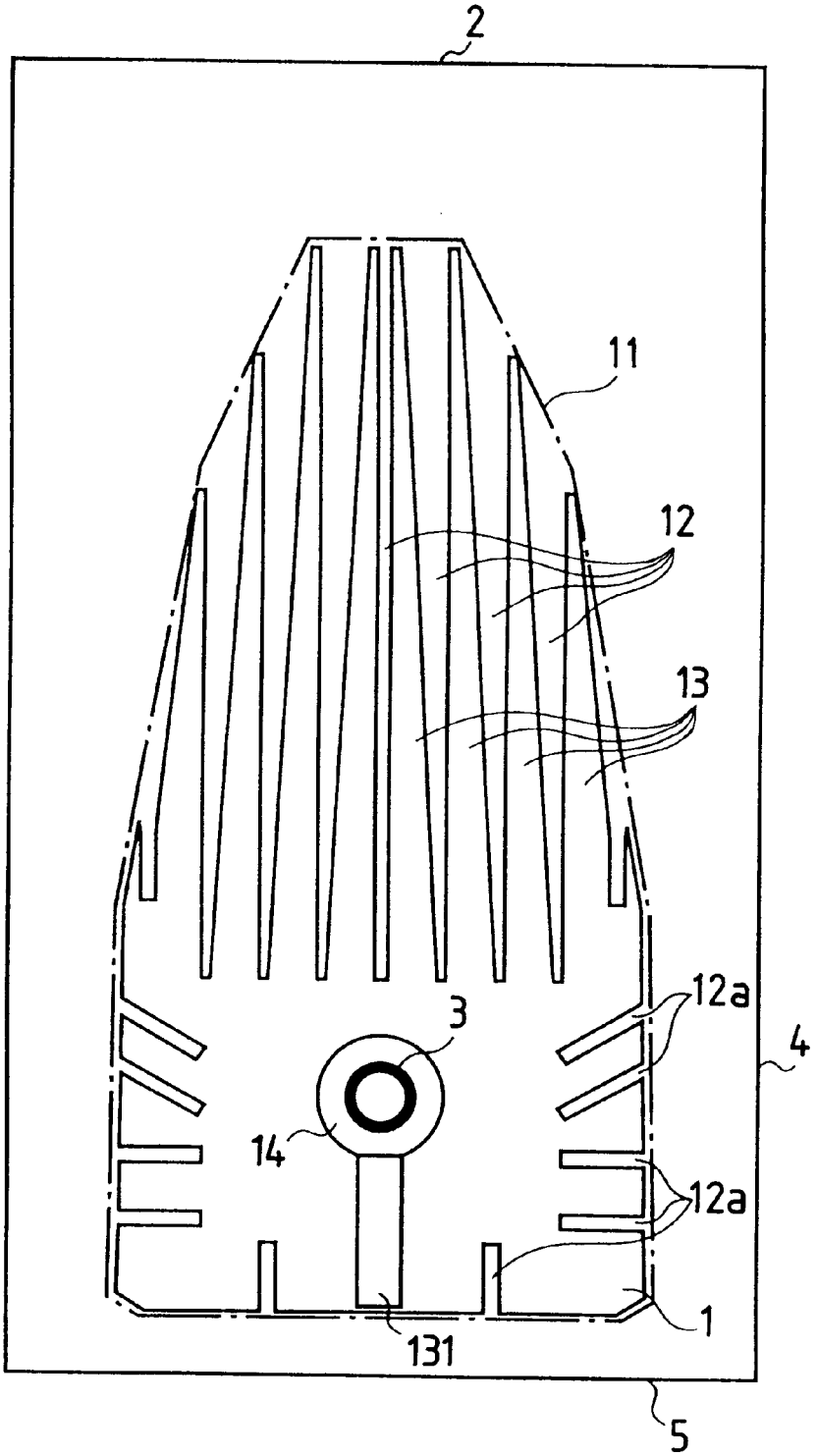
FIG. 12 is a sectional view of a tube nest in a sixth embodiment according to the present invention.

A tube nest 1 forming a sixth embodiment according to the present invention will be described with reference to FIG. 12, showing the tube nest 1 in sectional view, in which parts like or corresponding to those of the fifth embodiment are designated by the same reference numerals. The tube nest 1 in this embodiment is provided with a noncondensable gas cooling unit 131 disposed in a region below an extracting opening 3 where the steam velocity is comparatively low. Such an arrangement of the component parts can suppress influences attributable to the irregular arrangement of the cooling tubes caused by disposing the noncondensable gas cooling unit 131 in the tube nest 1 to the least extent.

Each of the tube nests in the foregoing embodiments has a vertically elongate shape having an aspect ratio more than 1, because the suction point is positioned within the steam condenser having a limited region, the aspect ratio of the massed tube nest is greater than 1, and the flow passages are formed longitudinally so as to extend along the incident direction of steam flow. However, in some cases, a tube nest having an aspect ratio less than 1 is necessary under the limitation of the layout of the power plant.

Figure 13:
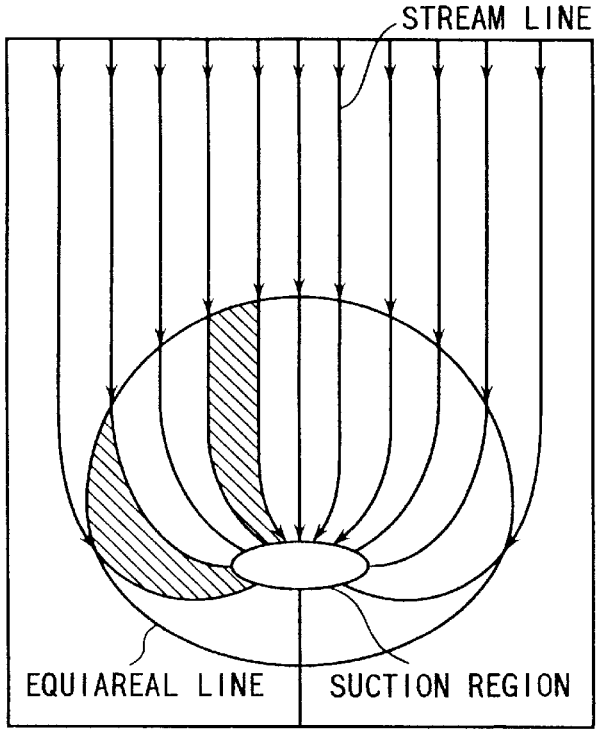
FIG. 13 is a diagrammatic view of a model of suction flow for a tube nest having an aspect ratio less than 1.
Figure 14:
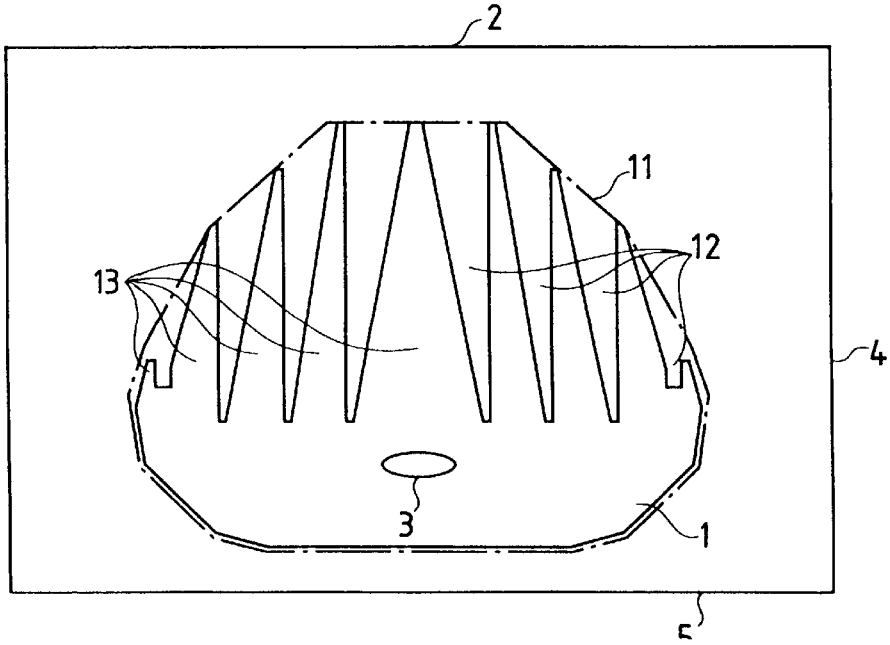
FIG. 14 is a sectional view of a tube nest in a seventh embodiment according to the present invention.

A tube nest 1 forming a seventh embodiment according to the present invention having an aspect ratio less than 1 will be described with reference to FIGS. 13 and 14. As shown in FIG. 13, the shape of a tube nest having an aspect ratio less than 1 can be determined by distributing suction points in a transversely elongate region. FIG. 14 shows a shape of a tube nest determined on the basis of a suction flow model shown in FIG. 13. In FIG. 14, parts like or corresponding to those shown in FIG. 8 are designated by the same reference numerals. The tube nest 1 in the seventh embodiment can be satisfactorily applied to a power plant requiring a transversely elongate steam condenser.

Figure 15:
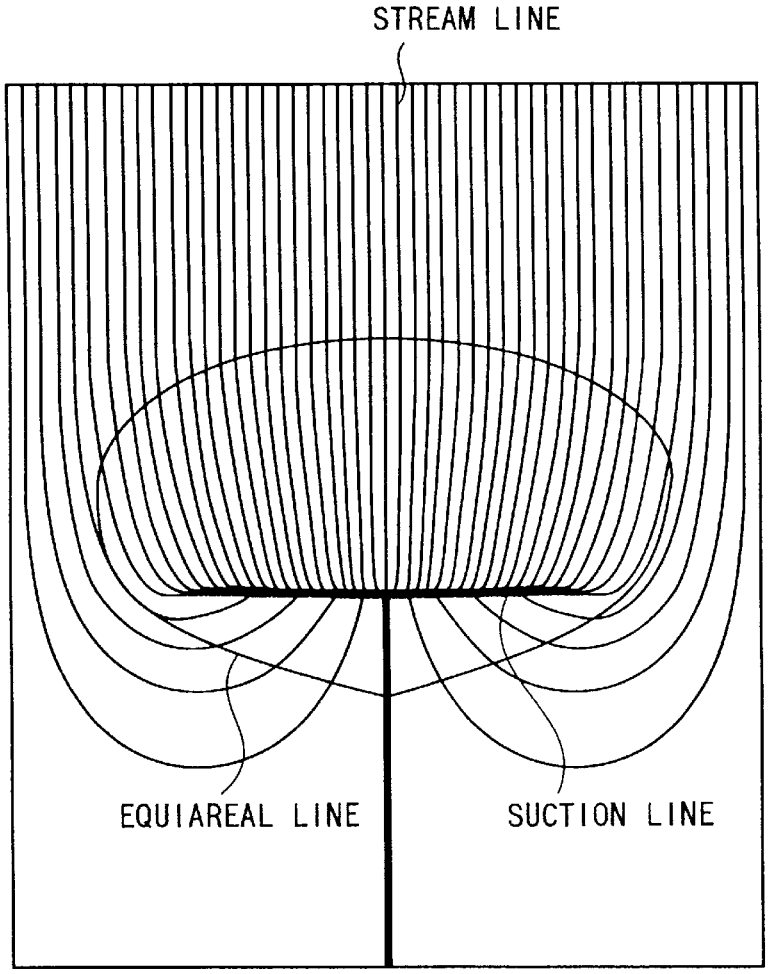
FIG. 15 is a diagrammatic view of a model of suction flow into a suction line.

The following is a detailed explanation of the structure of the tube nest in the seventh embodiment. FIG. 15 shows a suction flow when suction points are distributed within a horizontally elongated line (a suction line). In the case of a suction flow toward a suction point as described in FIG. 5, the distribution of stream lines is radially centered around the suction point and the distribution of the velocity of the suction flow is approximately uniform in the region near the suction point.

On the other hand, in case of a suction flow toward a suction line as shown in FIG. 15, intervals between stream lines is narrow above the suction line and is broad below the suction line. This means that the velocity of the suction flow varies discontinuously between the upper and lower regions of the suction line. Considering the condensation by the tube nest in the end region of the stream lines, i.e., the nearer region to the suction line, the discontinuity of the velocity does not appear because the velocity approaches 0. However, in the separated region from the suction line, a large difference in velocity between the upper and lower region appears. In the tube nest, pressure loss caused by the drag is generated according to the velocity. It is necessary to make each pressure loss in the upper and lower regions of the suction line substantially equal to maintain the end position of the stream line on the suction line. That is, since the velocity is high in the upper region of the suction line, the drag is reduced by controlling the flow passages in the upper region so as to reduce the pressure loss to the same degree as that of the lower region and maintain the suction line at the low pressure.

Figure 16:
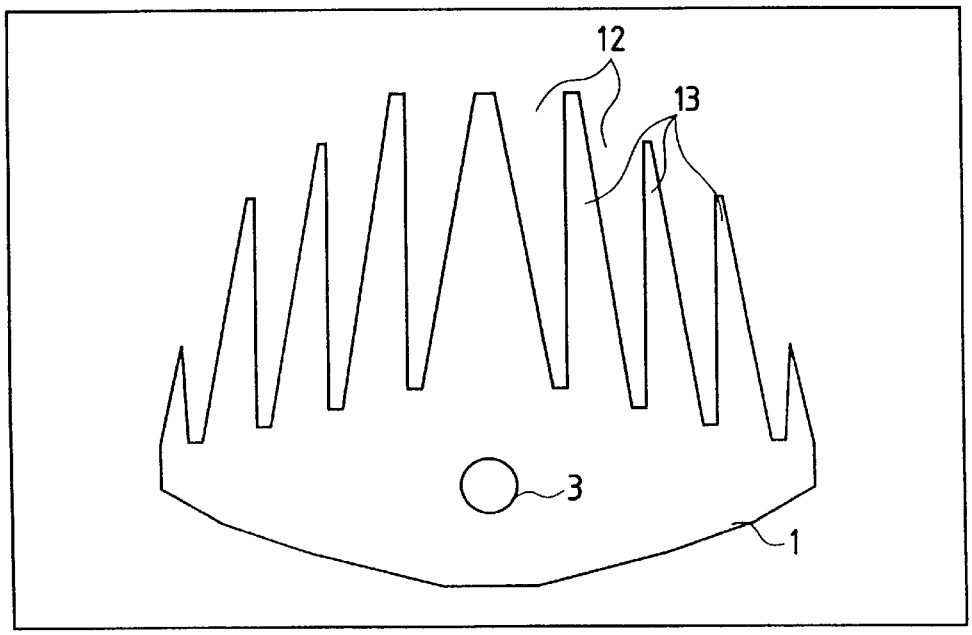
FIG. 16 is a sectional view of a tube nest in a eighth embodiment according to the present invention.

FIG. 16 shows the shape of a tube nest 1 based on an equiareal line of FIG. 15. In an eighth embodiment according to the present invention, as shown in FIG. 16, the tube nest 1 is provided with an extracting opening 3 at the center of the suction line in consideration of a space efficiency. It is necessary to make the extracting opening 3 responsive to the lowest pressure so as to collect noncondensable gases collected into the suction line at the extracting opening 3. For this purpose, the width of the massed tube nest near to the center axis above the extracting opening 3 in the vertical direction; i.e., the distance between the bottom end of the flow passage 12 and the extracting opening 3 in the vertical direction, is wider and the pressure loss becomes larger.

Figure 17:
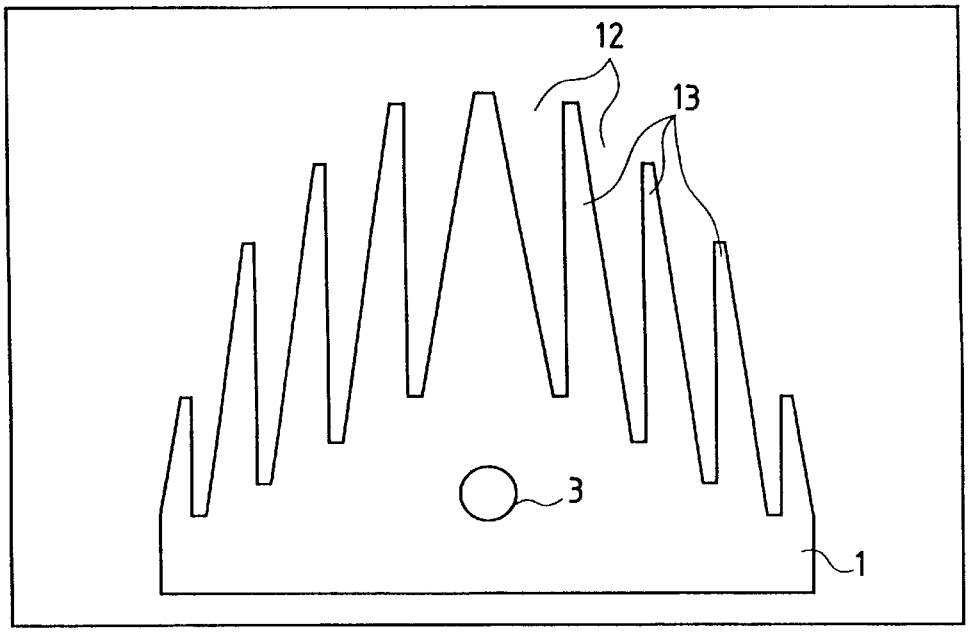
FIG. 17 is a sectional view of a tube nest in a ninth embodiment according to the present invention.

FIG. 17 is a ninth embodiment of the tube nest, representing a modification of the tube nest in FIG. 16, that has a straight bottom line. The stream lines of the suction flow in FIG. 15 are directed approximately in the vertical direction in the upper and lower regions near the suction line. Therefore, it is dominated by the vertical flow. In this case, since horizontal flow is little, when the tube nest is divided into number of regions in the horizontal direction, each region including each tube bundle 13 divided by flow passages 12 in the horizontal direction, each region is regarded as an individual region. In FIG. 17, the individual region farther from the center axis (or the extracting opening 3) is moved lower. The suction line is deformed to a curved line projecting above by the deformation of the tube nest 1. It is difficult to define the curved line itself. The extracting opening 3 is positioned at approximately the center of the massed tube nest and the width of the massed tube nest in the vertical direction, i.e., the distance between the bottom end of the flow passage 12 and the bottom end of the tube nest 1 in the vertical direction, nearer to the center axis is wider so that the noncondensable gases are collected into the extracting opening 3.

Figure 18:
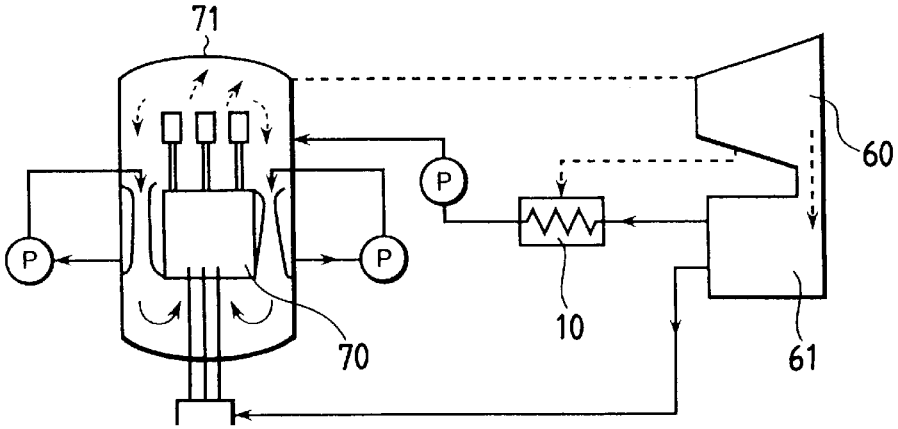
FIG. 18 is a diagrammatic view of a boiling water reactor type nuclear power plant employing a steam condenser according to the present invention.

A boiling water reactor type nuclear power plant (BWR plant) including a steam condenser embodying the present invention will be described with reference to FIG. 18. The BWR plant has, as principal components, a pressure vessel 71, a reactor core 70 installed in the pressure vessel 71, a high-pressure turbine 60, a low-pressure turbine 61 and a steam condenser 10. Any one of the first to the seventh embodiment may be used as the steam condenser 10. Steam generated by the reactor core 70 flows through the high-pressure turbine 60 and the low-pressure turbine 61 in that order, and then flows into the steam condenser 10. The steam condenser 10 condenses the steam into condensate and returns the condensate to the reactor core 70. Steam expands in the high-pressure turbine 60 and the low-pressure turbine 61 and then flows into the steam condenser. Therefore, the steam condenser 10 must have a large condensing capacity to condense a large amount of expanded steam.

Each of the steam condensers in the first to the seventh embodiment has a compact construction and a large condensing capacity. Therefore, the use of the steam condenser of the present invention realizes a compact BWR plant and reduces the construction costs of the BVWR plant. Since pressure loss in the steam condenser of the present invention is small, the exhaust pressure of the turbine can be reduced. Therefore, the steam pressure ratio between the inlet and the outlet of the turbine can be made large, which improves power generating efficiency. For example, the exhaust pressure of the turbine may be in the range of about 4700 to 4800 Pa, while the exhaust pressure of the turbine of the conventional BWR plant is about 5000 Pa.

Although the steam condenser of the present invention has been described as applied to a BWR plant, the present invention is applicable also to steam condensers for thermal power plants and condensers for chemical plants for the same effect.

What is claimed is:

1. A condenser comprising: a steam inlet through which steam is received; a tube nest comprising a plurality of cooling tubes for condensing the steam received through the steam inlet and at least one extracting means through which noncondensable gases contained in the steam are extracted; a condensate outlet through which condensate condensed by the cooling tubes is discharged; and a vessel surrounding the tube nest, characterized in that:

the tube nest has a massed region formed near the extracting means by arranging the cooling tubes densely so as to surround the extracting means;

the cooling tubes are arranged to form flow passages in a region between the massed region and the steam inlet, the flow passages extending from an outer circumference of the massed region toward the steam inlet substantially parallel to side walls of the vessel and having a larger width than diameters of the cooling tubes; and the tube nest is spaced from the side walls of the vessel and a minimum distance between an outer circumference of the tube nest and the side walls of the vessel is larger than a maximum width of the flow passages.

2. A condenser according to claim 1, wherein a ratio of a width of the tube nest to a width of the vessel is between about 0.5 and about 0.8.

3. A condenser according to claim 1, wherein a distance between the outer circumference of the tube nest and the side walls of the vessel nearer to the steam inlet is larger than a distance between the outer circumference of the tube nest and the side walls of the vessel further from the steam inlet.

4. A condenser according to claim 1 or 3, wherein a plurality of support plates for supporting the cooling tubes and the extracting means are arranged at a plurality of points in an axial direction of the cooling tubes, and an interval needed to weld the extracting means is maintained between a hole for the extracting means and a hole for cooling tube nearest to the extracting means on the support plate.

5. A condenser according to claim 1 or 3, wherein a part of the cooling tubes arranged in the massed region form a recondensing region for recondensing uncondensed steam extracted by the extracting means.

6. A power plant comprising: a steam turbine using steam for power generation; and a steam condenser for condensing steam discharged from the steam turbine;

characterized in that the steam condenser is the condenser described in any one of claims 1 to 3.

* * * * *